United States Patent [19]

Davis

[11] Patent Number: 4,745,710

[45] Date of Patent: May 24, 1988

[54] GUTTER SCREEN HAVING SPACED RIBS

[76] Inventor: Robert H. Davis, 294 Smyrna Powder Springs Rd., Mariatta, Ga. 30060

[21] Appl. No.: 907,653

[22] Filed: Sep. 15, 1986

[51] Int. Cl.[4] ..... E04D 13/00

[52] U.S. Cl. ..... 52/12; 52/94; 52/660; 210/473

[58] Field of Search ..... 52/11–16, 52/94, 660, 669, 97; 210/473, 474

[56] References Cited

U.S. PATENT DOCUMENTS

| | | | |
|---|---|---|---|
| 546,042 | 9/1895 | Van Horn | 52/12 |
| 2,674,961 | 4/1954 | Lake | 52/12 |
| 3,351,206 | 11/1967 | Wennestrom | 52/12 X |
| 3,436,878 | 4/1969 | Singer | 52/12 |
| 4,646,488 | 3/1987 | Burns | 52/94 |

FOREIGN PATENT DOCUMENTS

| | | | |
|---|---|---|---|
| 318698 | 12/1969 | Sweden | 52/12 |

*Primary Examiner*—David A. Scherbel
*Assistant Examiner*—Richard E. Chilcot, Jr.
*Attorney, Agent, or Firm*—Patrick F. Henry, Sr.

[57] ABSTRACT

Spaced elongated ribs each having a tapered end and a concave end are assembled together by means of elongated, spaced members inserted through respective spaced openings in each rib. The tapered ends of the ribs are attached to a common sheet of material which may be inserted underneath roofing shingles to position the entire assembly over a gutter to provide assistance to propel leaves, pine straw and other debris to the edge of the gutter but at the same time preventing the debris from entering the gutter while allowing the water to drain into the gutter. A continuous front member may be provided with clips for attachment to the edge of the gutter or may be omitted.

15 Claims, 1 Drawing Sheet

GUTTER SCREEN HAVING SPACED RIBS

The field of this invention is generally building construction and more particularly the covering of roof gutters in such a way as to allow the water to drain but to prevent the debris from entering the gutter by means of spaced ribs with members in the spaces.

Shields or covers for gutters are well known. Necessarily, such covers must allow the rainwaterto enter the gutter but at the same time attempt to prevent the entry of debris such as leaves which cause the gutters and the downspouts to clog. Some such arrangements are in the form of elongated screens which are inserted on one side beneath the lowermost shingles of the roof and then attached to the outer edge of the gutter. (see for example U.S. Pat. Nos. 4,418,504; 4,743,973; 3,023,544; or 4,395,852). Other gutter screen devices, however, do not attach to the roof or underneath the shingles but rather are attached to the edge of the gutter and lie on top of the roof (see U.S. Pat. Nos. 2,734,467 or 2,805,632). Regardless of the construction, all such prior gutter covers accumulate trash and debris on the top of the cover which prevents rain from entering the gutter and periodically this debris and trash must be removed. If the debris and trash accumulates very fast then the purpose of the gutter covers is substantially defeated because the water drain should be sufficient at all times and the accumulation of trash and debris on top of a gutter screen may impede the water more than the accumulation of the same amount of debris inside the gutter. Unfortunately, some prior gutter covers to not permit sufficient flow of water during a rain. Furthermore, if the trash and debris accumulates too fast then it may be more trouble and loss of time to clean the trash and debris off the covers than it would be to clean it out of the gutters. Therefore, regardless of the prior constructions there is still a critical need for a gutter cover which allows a maximum amount of water drainage into the gutter but at the same time allows as little accumulation as possible of trash and debris on top of cover and also is arranged in such a way as to encourage the water during heavy rain to wash the debris off the gutter cover so that the trash and debris does not impede the flow of water into the gutter. The present arrangement prevents debris and trash from entering the gutter and at the same time helps gravity and flowing water keep the cover free of debris and trash or at least encourage the wind, gravity and water flow to propel the trash and debris such as leaves and pine straw close enough to the edge to eventually fall. The tapered ribs permit trash and debris to move easily to the edge.

An object of this invention is to provide a gutter cover which allows the flow of water but assists in moving trash and debris off the gutter cover and to prevent same from entering the gutter.

A further object of this invention is to divert rainwater from the roof into the gutter while allowing trash and debris to be propelled to the edge of the roof and to the ground. The present arrangement assists gravity to propel the debris and trash to the edge of the roof.

Another advantage of the present invention is the construction whereby it may be molded from plastic or assembled from plastic pieces to be lightweight and relatively inexpensive as well as being easily stored and shipped such as in 4 ft. lengths.

Other and further objects and advantages of this invention will become apparent upon reading the following description of a preferred embodiment taken in conjunction with the accompanying drawings wherein.

DESCRIPTION OF A PREFERRED EMBODIMENT

Figure 1:
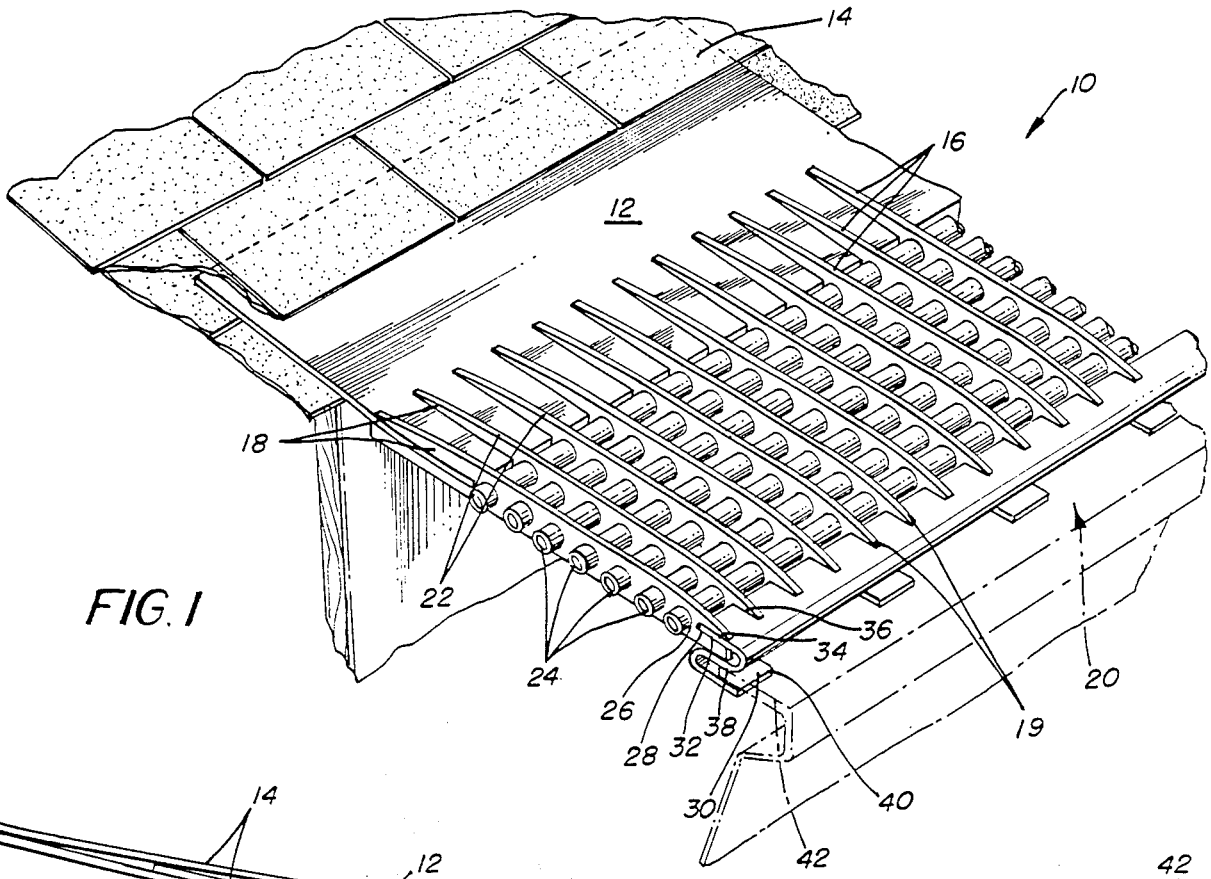
FIG. 1 is a perspective view of a short section of the present gutter cover showing a continuous front member having spaced attaching clips for attachment to the edge of the gutter.
Figure 2:
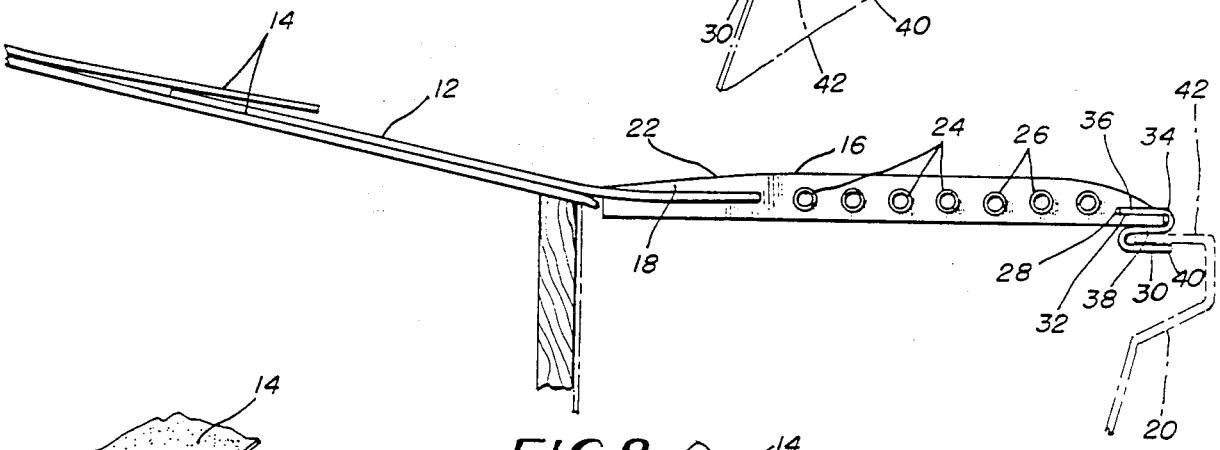
FIG. 2 is a side elevation view of the gutter cover shown in Fig. showing the tapered rib on the top end at the roof section.

The gutter cover 10 may be made, for example, in 4 ft. sections from plastic, aluminum, galvanized metal or other material with a sheet-like formation having an upper sheet portion 12 of continuous formation for insertion over or under roofing shingles 14 of a typical building structure.

A plurality of spaced ribs 16 have one inner end 18 molded with the sheet portion 12 and the other front or outer end 19 extending outwardly for positioning on the edge of a typical gutter 20. The ends 18 are tapered at 22 so as to provide a beveled surface which are extensions of the ribs 16 so as to assist in the movement of the water, trash and debris. All of the ribs 16 are attached together in an assembly or an array of ribs 16 by means of longitudinal attaching members 24 which may be plastic straws or tubes inserted through openings 26 in spaced relationship on each rib 16 and the openings in each rib are in alignment with corresponding respective openings 26 in all the other ribs so that the longitudinal attaching members 24 may be inserted therein and glued in place by cement or plastic solvent or other adhesive means. The front or outer end 19 of each rib is provided with an open notch 28 and all of such open notches are in alignment to receive a gutter attaching means comprising an elongated S-shaped member 30 having the edge 32 of an upper portion 34 inserted in all of the notches in a tight relationship therein whereby the top edge 36 of each of the front ends 19 of ribs 16 are attached in place on the upper portion 34 and are tapered smoothly on the top. The middle section 38 of the S-shaped member 30 is coextensive with the upper portion 34 and the lower section 40 is a plurality of spaced clips which may be resiliently and removeably attached to the outside edge 42 of the gutter 20.

Figure 3:
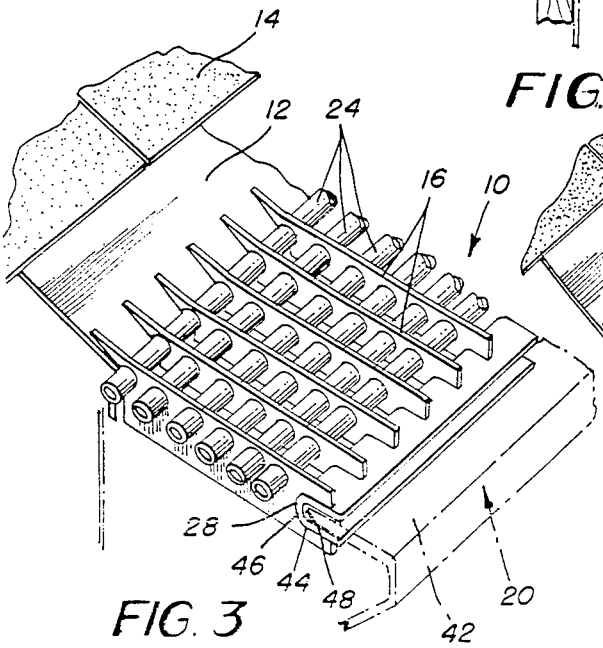
FIG. 3 is a perspective view of a first modified form of the invention having a different front edge.

In the form of first modified version in FIG. 3 the S-shaped member 30 is not present and is replaced by a single U-shaped member 44 which has the convex back edge 46 inserted in the notches 28 of the ribs 16 providing a concave slot 48 along the length of the U-shaped member 44 which receives the outside edge 42 of the gutter.

Figure 4:
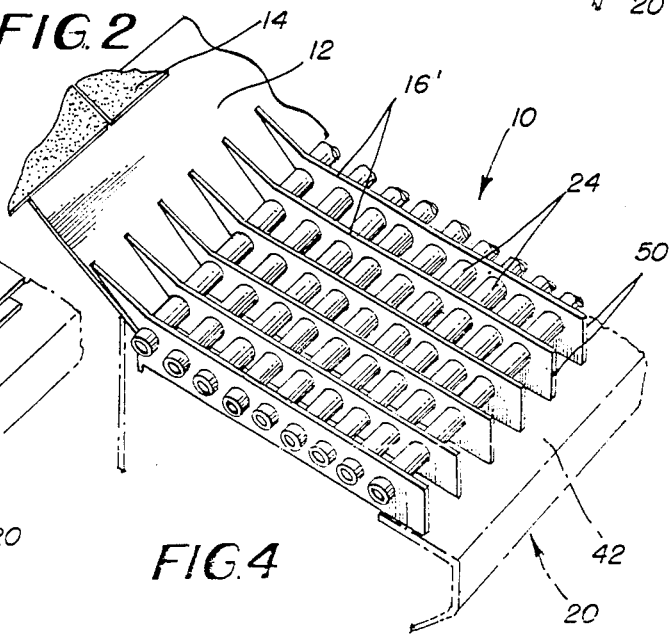
FIG. 4 is a perspective view of a second modified form of the invention having a different open front edge on top of the gutter edge.

In the form of the second modified version shown in FIG. 4 each modified rib 16' simply terminates in a blunt front edge 50 which does not attach to the gutter but either rests on top of the gutter outside edge 42 in the manner shown in FIG. 4, or abuts against the inside of the edge 42 in an obvious manner not shown in the drawings.

All of the foregoing arangements permit the gutter cover 10 to attach or engage the front edge 42 of most any five inch and six inch gutter and to slide horizontally freely so that separate lengths of gutter cover 10 can be installed and abutted together to form a continuous length of gutter cover. The tapered portion 22 of rib 16 makes it easy to insert the sheet portion 12 beneath roofing shingles 14 before being clipped on the front of the gutter (or caused to abut therewith in case of the version shown in FIG. 4). Thus, the gutter cover 10 keeps leaves, pine straw and other trash and debris from entering the gutter 20 but at the same time assists gravity to propel and remove leaves and other debris to the edge of the roof and allow it to fall to the ground due to the tapered portion 22 of each rib 16 which decreases the area of contact and friction thereby permitting the debris and trash to move more easily to the edge of the roof and to be affected more readily by wind and water and also makes it easier to remove the trash and debris from the top of the gutter cover 10 by blowing with a power blower, sweeping with a broom or a stick, or washing with a water hose.

A typical 4 ft. length of gutter cover would have about a 1" length of tapered portion 22 and the rib 16 are attached together by ten longitudinal attaching members 24 of approximately ⅛" in diameter for the entire length of each 4 ft. section thereby spacing each longitudinal attaching member 24 approximately 3/32" apart.

While I have shown and described a particular embodiment of this invention together with first and second modifications thereof this is by way of illustration only and does not constitute any sort of limitation on the scope of the invention since various alterations, changes, deviations, eliminations and departures may be made without departing from the scope of the invention as defined only be a proper interpretation of the claims.

I claim:

1. In a gutter cover for positioning on a roof to cover a gutter opening of a gutter having a front and a rear:

a plurality of spaced ribs, supported together in an array of ribs corresponding to the length of gutter, a roof member attached to said ribs for positioning on the roof, each of said ribs comprising an inner end and an outer end and said ribs being positioned substantially vertically over said gutter opening, means for connecting said ribs together in succession in spaced relationship from the roof member to the front edge of the gutter, forming openings to the gutter between said ribs, said means for connecting said ribs comprising a plurality of elongated members extending in spaced relationship between said ribs so as to provide openings between said ribs through which water will pass into said gutter while stopping at least some of the debris.

2. The device claimed in claim 1 wherein each rib has an inner end tapered toward the roof and joining the surface of said roof member.

3. The device claimed in claim 1 wherein there is a means on the outer end of said ribs for engaging the gutter cover with the front of the gutter.

4. The device claimed in claim 3 wherein said means for engaging comprises an elongated member having an opening therein for engagement with the gutter.

5. The device claimed in claim 4 wherein said elongated member comprises two elongated portions in opposed relationship, and spaced clip members resiliently mounted for attachment to the gutter.

6. The device claimed in claim 4 wherein said means for engaging comprises a U-shaped member having a concave portions for removable engagement to the front of the gutter.

7. The device claimed in claim 1 wherein each of said ribs has a terminal end spaced from each other in succession.

8. The device in claim 7 wherein each terminal end is tapered.

9. The device in claim 8 including means for engagement said gutter cover with the front of the gutter.

10. The device in claim 9 wherein said means for engaging comprises an elongated member having a cavity therein which fits over the front of the gutter.

11. The device in claim 1 wherein said ribs have tapered terminal ends.

12. The device claimed in claim 1 wherein said elongated members are each of said ribs having an upper edge located above said elongated members thereby providing a channel trough between said ribs for channeling water to said gutter.

13. The device in claim 12 wherein said ribs have tapered terminal ends.

14. The device claimed in claim 1 wherein the outer end of each rib has a notch therein, and an attaching member mounted in said notches and having means thereon for removable attachment to the gutter.

15. The device in claim 1 wherein the outer end of each rib has a notch therein, and an attaching member mounted in said notches and having means thereon for removable attachment to the gutter.

* * * * *